US009795847B2

(12) United States Patent
Nakamura et al.

(10) Patent No.: US 9,795,847 B2
(45) Date of Patent: Oct. 24, 2017

(54) GOLF CLUB

(71) Applicant: DUNLOP SPORTS CO. LTD., Kobe, Hyogo (JP)

(72) Inventors: Hirotaka Nakamura, Kobe (JP); Tatsuya Yashiki, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/088,989

(22) Filed: Apr. 1, 2016

(65) Prior Publication Data

US 2016/0346651 A1 Dec. 1, 2016

(30) Foreign Application Priority Data

May 29, 2015 (JP) ..... 2015-109994

(51) Int. Cl.
*A63B 53/10* (2015.01)
*A63B 60/08* (2015.01)

(52) U.S. Cl.
CPC ..... *A63B 53/10* (2013.01); *A63B 60/08* (2015.10); *A63B 2209/023* (2013.01)

(58) Field of Classification Search
CPC ... A63B 53/12; A63B 2060/002; A63B 53/10; A63B 60/08; A63B 2209/023
See application file for complete search history.

(56) References Cited

U.S. PATENT DOCUMENTS 8,678,945 B2 * 3/2014 Rice ..... A63B 53/10 473/292
9,211,454 B2 * 12/2015 Matsunaga ..... A63B 53/10
2012/0295730 A1 * 11/2012 Hasegawa ..... A63B 53/10 473/292
2012/0295734 A1 * 11/2012 Hasegawa ..... A63B 53/10 473/319
2012/0309558 A1 * 12/2012 Nakano ..... A63B 53/10 473/323
2013/0095950 A1 * 4/2013 Hasegawa ..... A63B 53/10 473/318
2013/0165250 A1 * 6/2013 Takeuchi ..... A63B 53/10 473/319

FOREIGN PATENT DOCUMENTS

JP 2012-239574 A 12/2012
JP 2013-81694 A 5/2013

* cited by examiner

*Primary Examiner* — Stephen Blau
(74) *Attorney, Agent, or Firm* — Birch, Stewart, Kolasch & Birch, LLP

(57) ABSTRACT

A golf club 2 includes a head 4, a shaft 6 and a grip 8. The shaft 6 includes a plurality of layers, a tip end Tp and a butt end Bt. If a distance between a center of gravity of the shaft and the butt end Bt is defined as Lg (mm), a shaft full length is defined as Ls (mm), and a ratio of the distance Lg to the shaft full length Ls is defined as a ratio of the center of gravity of the shaft, the ratio of the center of gravity of the shaft is 44.5% or less. If a torsional rigidity at a point of 90 mm distant from the tip end Tp is defined as GJt (kgf·m$^2$), and a torsional rigidity at a point of 210 mm distant from the butt end Bt is defined as GJb (kgf·m$^2$), GJb/GJt is 5.5 or less.

9 Claims, 5 Drawing Sheets

GOLF CLUB

The present application claims priority on Patent Application No. 2015-109994 filed in JAPAN on May 29, 2015, the entire contents of which are hereby incorporated by reference.

BACKGROUND OF THE INVENTION

Field of the Invention

The present invention relates to a golf club.

Description of the Related Art

A golf club shaft in which a center of gravity of the shaft is considered has been proposed. Japanese Patent Application Laid-Open No. 2012-239574 (US2012/0295734) discloses a shaft having a ratio of a center of gravity of the shaft of 0.52 or greater but 0.65 or less. The ratio of the center of gravity of the shaft is based on a distance from a tip end of the shaft.

SUMMARY OF THE INVENTION

The above mentioned conventional technique is effective in improving a head speed. On the other hand, the demand by golf players has been more and more increased. The present inventors have found a room for improvement in shaft performance.

It is an object of the present invention to provide a golf club that contributes to improvement in a head speed and is easy to capture a ball.

A preferable club includes a shaft, a head, and a grip. The shaft includes a plurality of layers, a tip end, and a butt end. If a distance between a center of gravity of the shaft and the butt end is defined as Lg (mm), a full length of the shaft is defined as Ls (mm), and a ratio of the distance Lg to the full length Ls of the shaft is defined as a ratio of the center of gravity of the shaft, then the ratio of the center of gravity of the shaft is equal to or less than 44.5%. A torsional rigidity at a point of 90 mm distant from the tip end is defined as GJt ($kgf \cdot m^2$), and a torsional rigidity at a point of 210 mm distant from the butt end is defined as GJb ($kgf \cdot m^2$). GJb/GJt is equal to or less than 5.5.

Preferably, a flex point ratio of the shaft is equal to or less than 0.50. If a forward flex is defined as f1, and a backward flex is defined as f2, the flex point ratio C of the shaft is calculated by the following formula:

$$C=f2/(f1+f2).$$

Preferably, the layers include a full length bias layer, a full length straight layer, and a butt partial layer. A region between a point of 180 mm distant from the tip end and the tip end is defined as a specific tip part. A region between a point of 420 mm distant from the butt end and the butt end is defined as a specific butt part. A weight of the specific tip part is defined as W1, and a weight of the full length bias layer on the specific tip part is defined as W1*a*. A weight of the specific butt part is defined as W2, a weight of the full length bias layer on the specific butt part is defined as W2*a*, and a weight of the butt partial layer on the specific butt part is defined as W2*b*. Preferably, W1*a*/W1 is equal to or greater than 0.20. Preferably, W2*b*/W2 is equal to or greater than 0.40. Preferably, W2*b*/W2*a* is equal to or greater than 1.7.

Preferably, the head has a weight of equal to or greater than 200 g.

In the present invention, a golf club shaft that contributes to improvement in a head speed and is easy to capture a ball can be obtained.

DESCRIPTION OF THE PREFERRED EMBODIMENTS

The present invention will be described later in detail based on preferred embodiments with appropriate reference to the drawings.

In the present application, an "axial direction" means an axial direction of a shaft. In the present application, a "radial direction" means a radial direction of the shaft. In the present application, a "region" means a region in the axial direction.

Figure 1:
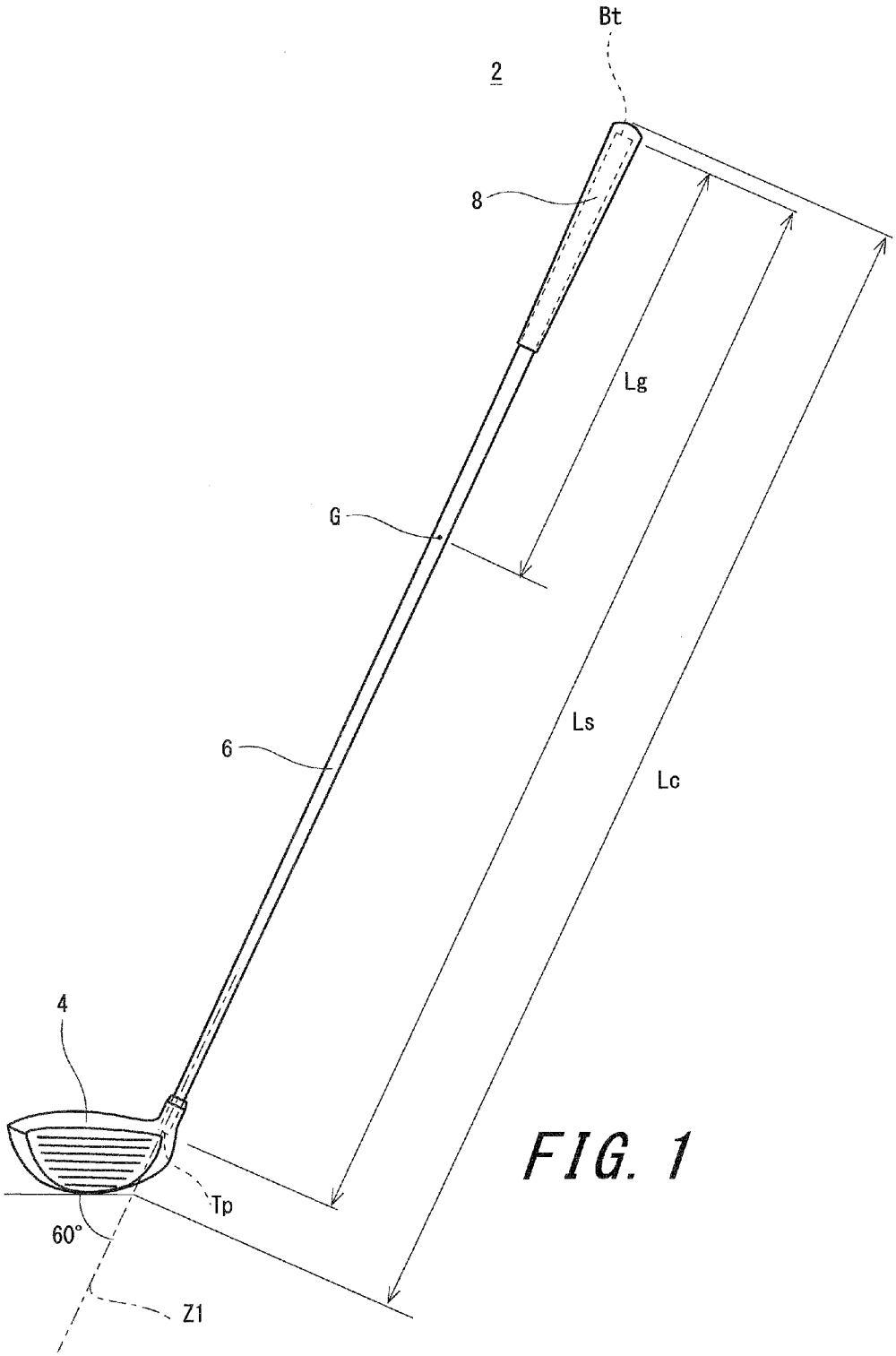
FIG. 1 shows a golf club including a shaft according to an embodiment.

FIG. 1 shows a golf club 2 according to an embodiment of the present invention. The golf club 2 includes a head 4, a shaft 6, and a grip 8. The head 4 is attached to a tip portion of the shaft 6. The grip 8 is attached to a butt portion of the shaft 6. The head 4 has a hollow structure. The head 4 is a wood-type head. The golf club 2 is a driver (a number 1 wood).

As described below, the present invention improves the turn of the head to obtain a golf club easy to capture a ball. The longer a club length Lc is, the harder to turn the head is. For this reason, the longer the club length Lc is, the more conspicuous the effect of the present invention is. In this respect, the golf club 2 has a length Lc of preferably equal to or longer than 43 inches, more preferably equal to or longer than 44 inches, and still more preferably equal to or longer than 45 inches. In light of easiness of swing, the length Lc of the golf club 2 is preferably equal to or shorter than 48 inches, and more preferably equal to or shorter than 47 inches. In light of flight distance, a preferable head 4 is a wood-type golf club head. Preferably, the golf club 2 is a wood-type golf club.

The length Lc of the golf club 2 is measured based on "1c Length" in "1 Clubs" of "Appendix II Design of Clubs" in the Golf Rules defined by R&A (Royal and Ancient Golf club of Saint Andrews). The length is measured in a state where a club is placed on a horizontal plane and a sole is set against a plane of which an angle with respect to the horizontal plane is 60 degrees (see FIG. 1). The method for measuring the club length Lc is referred to as a 60-degrees method.

A shaft length is shown by a double-pointed arrow Ls in FIG. 1. The shaft length Ls is a distance between a tip end Tp and a butt end Bt. The distance is measured along the axial direction.

As shown in FIG. 1, the shaft 6 includes a tip end Tp and a butt end Bt. In the golf club 2, the tip end Tp is located in the head 4. In the golf club 2, the butt end Bt is located in the grip 8.

A tip part of the shaft 6 is inserted into a hosel hole of the head 4. The axial-direction length of a portion of the shaft 6 inserted into the hosel hole is usually 25 mm or greater but 70 mm or less.

As shown in FIG. 1, the shaft 6 has a center of gravity G. The center of gravity G is a center of gravity of only the shaft. The center of gravity G is positioned on an axis line Z1 of the shaft.

In FIG. 1, a distance between the butt end Bt and the center of gravity G is shown by a double-pointed arrow Lg. In the present application, a ratio of a center of gravity of a shaft is defined based on Lg/Ls. The ratio (%) of the center of gravity of a shaft is calculated by the following formula:

$$\text{The ratio of the center of gravity of a shaft} = Lg/Ls \times 100.$$

This is the ratio of a center of gravity of a shaft on the basis of the distance from the butt end Bt. The smaller the ratio of the center of gravity of the shaft is, the nearer to the butt end Bt the center of gravity G is.

The shaft 6 is a laminate of fiber reinforced resin layers. The shaft 6 is a so-called carbon shaft. The shaft 6 is a tubular body.

The shaft 6 is formed by curing a wound prepreg sheet. In a typical prepreg sheet, fibers are oriented substantially in one direction. The prepreg is also referred to as a UD prepreg. The term "UD" stands for uni-direction. Prepregs which are not the UD prepreg may be used. For example, fibers contained in the prepreg sheet may be woven.

The prepreg sheet has a fiber and a resin. The resin is also referred to as a matrix resin. Typically, the fiber is a carbon fiber. Typically, the matrix resin is a thermosetting resin.

The shaft 6 is manufactured by a so-called sheet-winding method. In the prepreg, the matrix resin is in a semi-cured state. The shaft 6 is obtained by winding and curing the prepreg sheet.

The matrix resin may be a thermosetting resin, or may be a thermoplastic resin. Typical examples of the matrix resin include an epoxy resin. In light of shaft strength, the matrix resin is preferably an epoxy resin.

Examples of the fiber include a carbon fiber, a glass fiber, an aramid fiber, a boron fiber, an alumina fiber, and a silicon carbide fiber. Two or more of the fibers may be used in combination. In light of the shaft strength, the fiber is preferably the carbon fiber and the glass fiber, and more preferably the carbon fiber.

Figure 2:
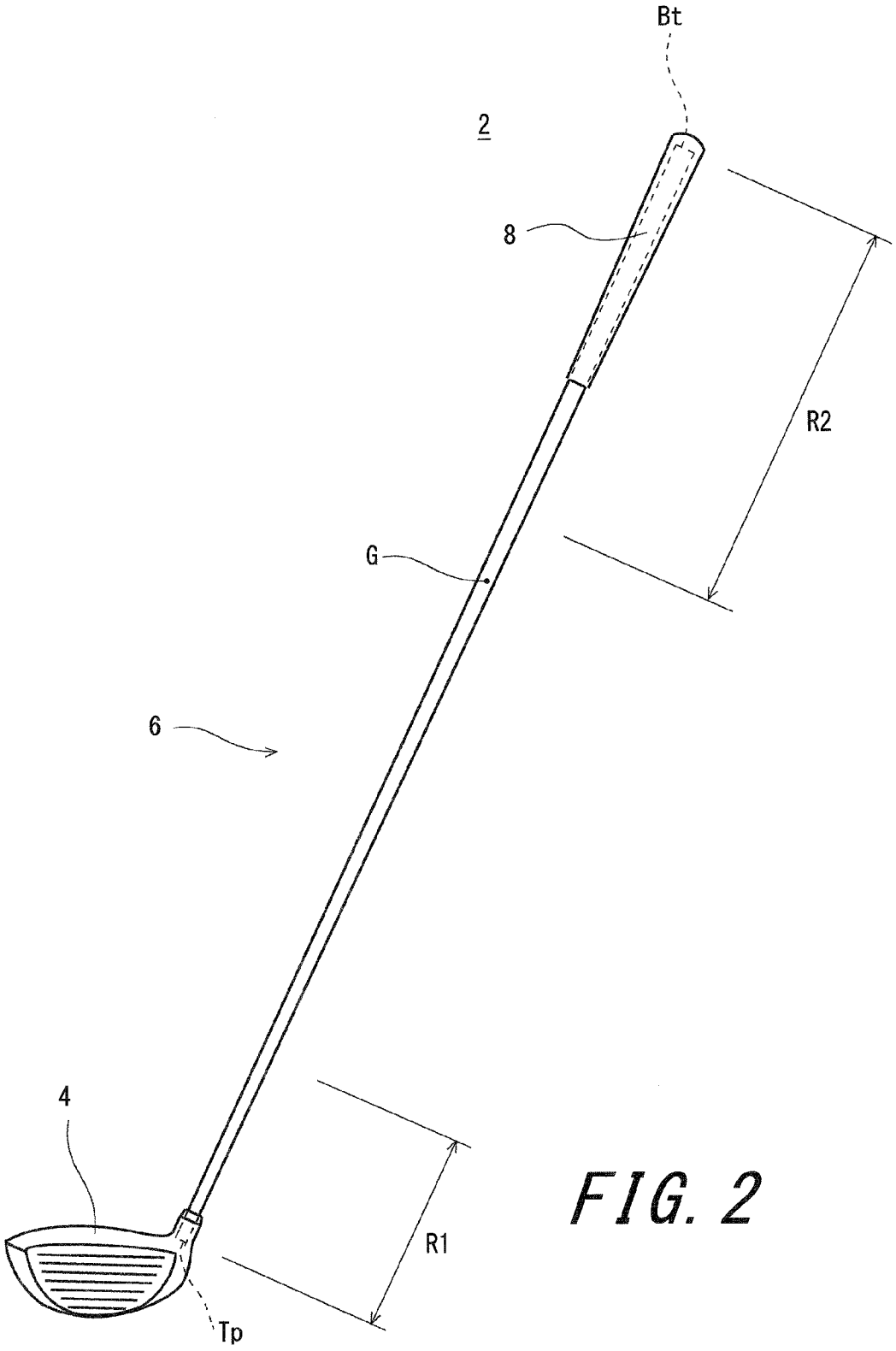
FIG. 2 shows the same golf club as in FIG. 1.

FIG. 2 is an overall view of the golf club 2, like FIG. 1. As shown in FIG. 2, in the present application, a specific tip part R1 and a specific butt part R2 are defined. A region between a point of 180 mm distant from the tip end Tp and the tip end Tp is the specific tip part R1. A region between a point of 420 mm distant from the butt end Bt and the butt end Bt is the specific butt part R2. The grip 8 is positioned on the specific butt part R2. The head 4 is positioned on the specific tip part R1.

In the present application, a flex point ratio of the shaft 6 is considered. The flex point ratio of a shaft in the present application is defined as follows. If a forward flex is defined as f1, and a backward flex is defined as f2, the flex point ratio C of the shaft is calculated by the following formula:

$$C = f2/(f1+f2).$$

[Forward Flex f1]

Figure 3A:
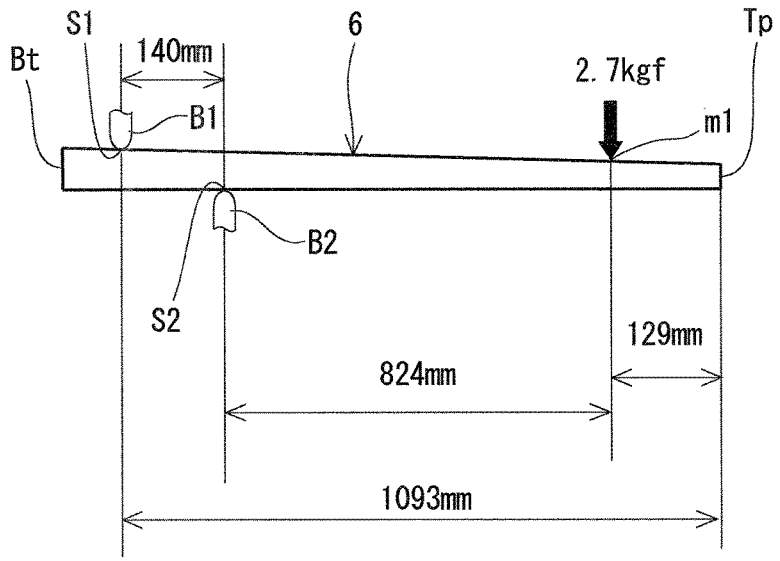
FIG. 3(*a*) shows a method for measuring a forward flex, and FIG. 3(*b*) shows a method for measuring a backward flex.
Figure 3B:
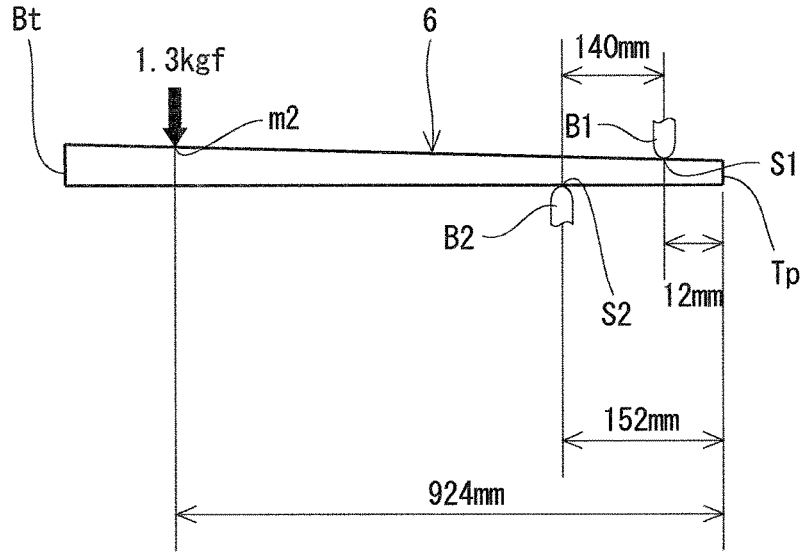

FIG. 3(*a*) shows a method for measuring a forward flex f1. As shown in FIG. 3(*a*), a first supporting point S1 is set at a position of 1093 mm distant from the tip end Tp. Furthermore, a second supporting point S2 is set at a position of 953 mm distant from the tip end Tp. A support B1 supporting the shaft 6 from above is provided at the first supporting point S1. A support B2 supporting the shaft 6 from the underside is provided at the second supporting point S2. In a state where no load is applied, the shaft axis line of the shaft 6 is horizontal. At a load point m1 of 129 mm distant from the tip end Tp, a load of 2.7 kgf is allowed to act in a vertical downward direction. A distance (mm) between the position of the load point m1 at a state where no load is applied and the position of the load point m1 at a state where the load is applied to settle the position is the forward flex. The distance is measured along the vertical direction.

The section shape of a portion (hereinafter, referred to as an abutting portion) of the support B1 abutting on the shaft is as follows. The section shape of the abutting portion of the support B1 has convex roundness in a section parallel to the axial direction of the shaft. The curvature radius of the roundness is 15 mm. The section shape of the abutting portion of the support B1 has concave roundness in a section perpendicular to the axial direction of the shaft. The curvature radius of the concave roundness is 40 mm. The horizontal length (a length in a depth direction in FIG. 3(*a*)) of the abutting portion of the support B1 is 15 mm in the section perpendicular to the axial direction of the shaft. The section shape of the abutting portion of the support B2 is the same as that of the support B1. The section shape of the abutting portion of a load indenter (not shown) applying a load of 2.7 kgf to the load point m1 has convex roundness in the section parallel to the axial direction of the shaft. The curvature radius of the roundness is 10 mm. The section shape of the abutting portion of a load indenter (not shown) applying a load of 2.7 kgf to the load point m1 is a straight line in the section perpendicular to the axial direction of the shaft. The length of the straight line is 18 mm. A weight including the load indenter is hung at the load point m1.

[Backward Flex f2]

FIG. 3(*b*) shows a method for measuring a backward flex f2. The backward flex is measured in the same manner as in the forward flex except that the first supporting point S1 is set to a point of 12 mm distant from the tip end Tp; the second supporting point S2 is set to a point of 152 mm distant from the tip end Tp; a load point m2 is set to a point of 924 mm distant from the tip end Tp; and a load is set to 1.3 kgf.

In the present application, a torsional rigidity GJ at a point of 90 mm distant from the tip end Tp is defined as GJt (kgf·m$^2$). A torsional rigidity GJ at a point of 210 mm distant from the butt end is defined as GJb (kgf·m$^2$).

Figure 4:
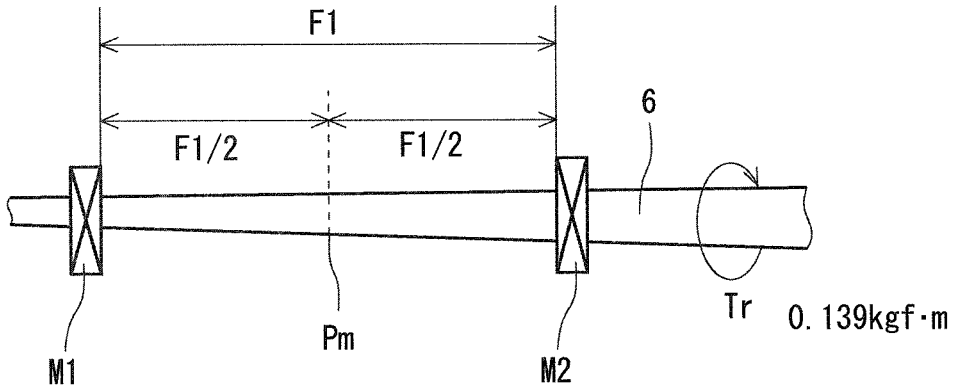
FIG. 4 shows a method for measuring a torsional rigidity GJ.

FIG. 4 shows a method for measuring a torsional rigidity GJ at a measurement point Pm. A first position is fixed by a jig M1, and a second position of F1 mm distant from the jig M1 is held by a jig M2. In a measurement at the point of 90 mm distant from the tip end Tp, the distance F1 is set to 100 mm. In a measurement at the point of 210 mm distant from the butt end Bt, the distance F1 is set to 300 mm. The measurement point Pm is a point by which the distance between the first position and the second position is divided into two equal parts. A torsion angle A of the shaft 6 when a torque Tr of 0.139 (kgf·m) is applied to the jig M2 is measured. The torsional rigidity GJ is calculated by the following formula:

$$GJ(\text{kgf}\cdot\text{m}^2) = M \times Tr/A.$$

M is a measuring span (m); Tr is a torque (kgf·m); and A is a torsion angle (radian). The measuring span M is 0.1 m in a measurement at the point of 90 mm distant from the tip end Tp, and is 0.3 m in a measurement at the point of 210 mm distant from the butt end Bt. The torque Tr is 0.139 (kgf·m$^2$).

In the measurement of the torsional rigidity GJt, the measurement point Pm is the point of 90 mm distant from the tip end Tp. In the measurement of the torsional rigidity GJb, the measurement point Pm is the point of 210 mm distant from the butt end Bt. In the present application, a ratio (GJb/GJt) is considered. In the present application, the ratio GJb/GJt is also referred to as GJ ratio.

Figure 5:
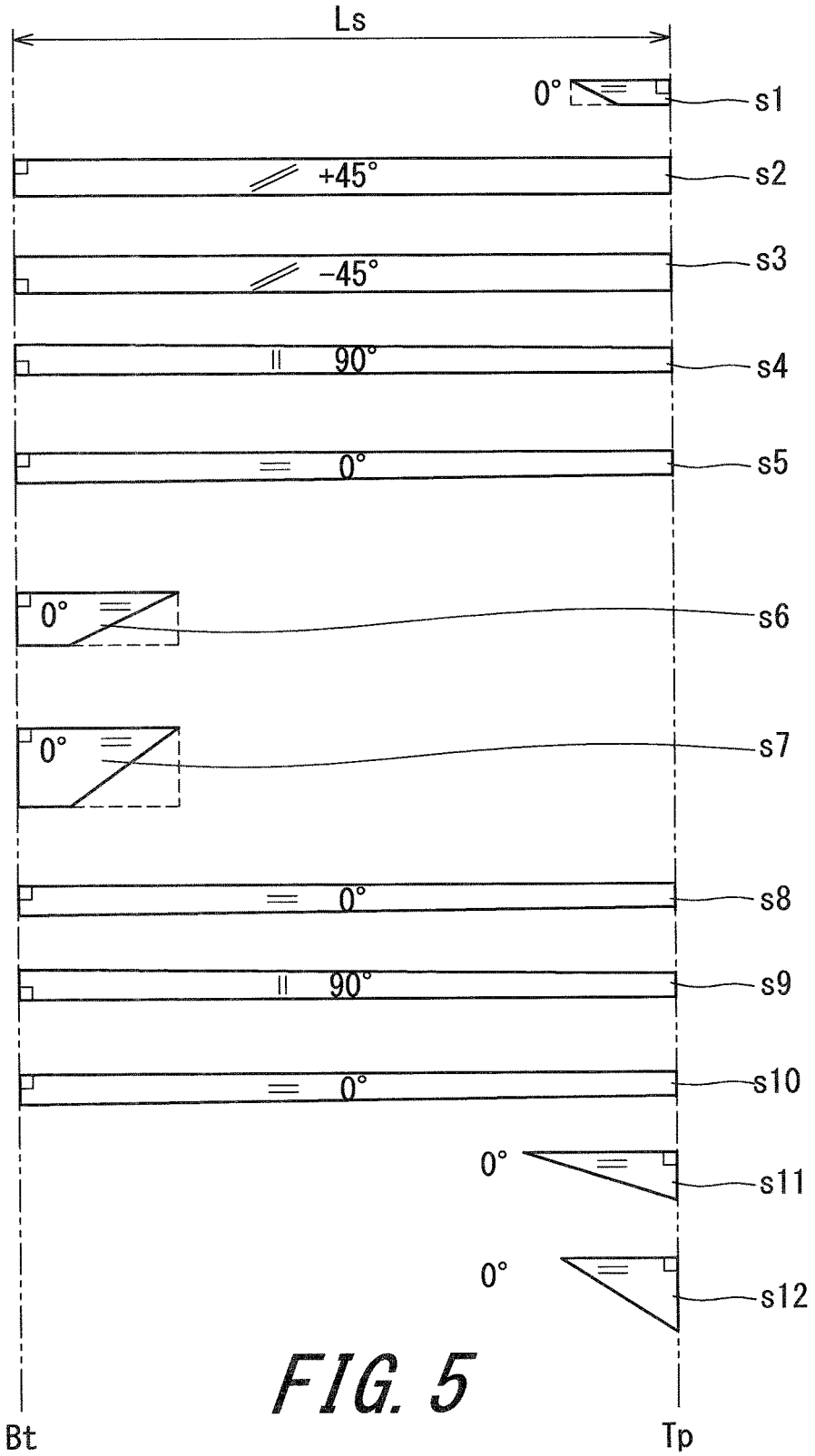
FIG. 5 is a developed view showing an example of a laminated constitution of the shaft.

FIG. 5 is a developed view (laminated constitution view) of a prepreg sheet constituting the shaft 6.

The shaft 6 is constituted with a plurality of sheets. The shaft 6 is constituted with twelve sheets of a first sheet s1 to a twelfth sheet s12. The developed view shows the sheets constituting the shaft in order from the radial inside of the shaft. The sheets are wound in order from the sheet located on the uppermost side in the developed view. In the developed view, the horizontal direction of the figure coincides with the axial direction of the shaft. In the developed view, the right side of the figure is the tip end Tp side of the shaft. In the developed view, the left side of the figure is the butt end Bt side of the shaft.

The developed view shows not only the winding order of the sheets but also the disposal of each of the sheets in the axial direction of the shaft. For example, in FIG. 5, an end of the first sheet s1 is located at the tip end Tp. For example, in FIG. 5, an end of the sixth sheet s6 is located at the butt end Bt.

The term "layer" and the term "sheet" are used in the present application. The "layer" is a term for after being wound. Meanwhile, the "sheet" is a term for before being wound. The "layer" is formed by winding the "sheet". That is, the wound "sheet" forms the "layer". In the present application, the same symbol is used in the layer and the sheet. For example, a layer formed by a sheet s1 is a layer s1.

The shaft 6 includes a straight layer, a bias layer, and a hoop layer. An orientation angle Af of the fiber is described for each of the sheets in the developed view of the present application. The orientation angle Af is an angle with respect to the axial direction the shaft.

The shaft 6 includes two bias layers. Three or more bias layers may be provided. The shaft 6 includes two or more straight layers.

A sheet described as "0°" constitutes the straight layer. The sheet constituting the straight layer is also referred to as a straight sheet.

The straight layer is a layer in which the angle Af is substantially set to 0 degree. Usually, the angle Af is not completely set to 0 degree due to error or the like in winding.

Usually, in the straight layer, an absolute angle θa is equal to or less than 10 degrees. The absolute angle θa is an absolute value of the orientation angle Af. For example, "the absolute angle θa is equal to or less than 10 degrees" means that "the angle Af is −10 degrees or greater and +10 degrees or less".

In the embodiment of FIG. 5, the straight sheets are the sheet s1, the sheet s5, the sheet s6, the sheet s7, the sheet s8, the sheet s10, the sheet s11, and the sheet s12.

The bias layer is highly correlated with the torsional rigidity and torsional strength of the shaft. Preferably, a bias sheet includes two sheets in which orientation angles of fibers are inclined in opposite directions to each other. In light of the torsional rigidity, the absolute angle θa of the bias layer is preferably equal to or greater than 15 degrees, more preferably equal to or greater than 25 degrees, and still more preferably equal to or greater than 40 degrees. In light of the torsional rigidity and flexural rigidity, the absolute angle θa of the bias layer is preferably equal to or less than 60 degrees, and more preferably equal to or less than 50 degrees.

In the shaft 6, the sheets constituting the bias layer are the second sheet s2 and the third sheet s3. The sheet s2 is also referred to as a first bias sheet. The sheet s3 is also referred to as a second bias sheet. As described above, in FIG. 5, the angle Af is described in each sheet. The plus (+) and minus (−) in the angle Af show that the fibers of bias sheets are inclined in opposite directions to each other. In the present application, the sheet constituting the bias layer is also merely referred to as a bias sheet. The sheet s2 and the sheet s3 constitute a united sheet to be described later.

In FIG. 5, the inclination direction of the fiber of the sheet s3 is equal to the inclination direction of the fiber of the sheet s2. However, the sheet s3 is reversed, and applied on the sheet s2. As a result, the direction of the angle Af of the sheet s2 and the direction of the angle Af of the sheet s3 are opposite to each other. In light of this point, in the embodiment of FIG. 5, the angle Af of the sheet s2 is described as +45 degrees and the angle Af of the sheet s3 is described as −45 degrees.

The shaft 6 has a hoop layer. The shaft 6 has a plurality of hoop layers. The shaft 6 includes two hoop layers. In the shaft 6, the hoop layers are the layer s4 and the layer s9. In the shaft 6, the sheets constituting the hoop layers are the fourth sheet s4 and the ninth sheet s9. In the present application, the sheet constituting the hoop layer is also referred to as a hoop sheet.

Preferably, the absolute angle θa in the hoop layer is substantially 90 degrees to the axis line of the shaft. However, the orientation direction of the fiber to the axial direction of the shaft may not be completely set to 90 degrees due to an error or the like in winding. In the hoop layer, the angle Af is usually −90 degrees or greater and −80 degrees or less, or 80 degrees or greater and 90 degrees or less. In other words, in the hoop layer, the absolute angle θa is usually 80 degrees or greater and 90 degrees or less.

The number of the layers to be formed from one sheet is not limited. For example, if the number of plies of the sheet is 1, the sheet is wound by one round in a circumferential direction. If the number of plies of the sheet is 1, the sheet forms one layer at all positions in the circumferential direction of the shaft.

For example, if the number of plies of the sheet is 2, the sheet is wound by two rounds in the circumferential direction. If the number of plies of the sheet is 2, the sheet forms two layers at the all positions in the circumferential direction of the shaft.

For example, if the number of plies of the sheet is 1.5, the sheet is wound by 1.5 rounds in the circumferential direction. When the number of plies of the sheet is 1.5, the sheet forms one layer at the circumferential position of 0 to 180 degrees, and forms two layers at the circumferential position of 180 degrees to 360 degrees.

In light of suppressing winding fault such as wrinkles, a sheet having a too large width is not preferable. In this respect, the number of plies of one bias sheet is preferably equal to or less than 4, and more preferably equal to or less than 3. In light of the working efficiency of the winding process, the number of plies of the bias sheet is preferably equal to or greater than 1.

In light of suppressing winding fault such as wrinkles, a sheet having a too large width is not preferable. In this respect, the number of plies of one straight sheet is preferably equal to or less than 4, more preferably equal to or less than 3, and still more preferably equal to or less than 2. In light of the working efficiency of the winding process, the number of plies of the straight sheet is preferably equal to or greater than 1. The number of plies may be 1 in all the straight sheets.

In a full length sheet, winding fault is apt to occur. In light of suppressing the winding fault, the number of plies of one sheet in all full length straight sheets is preferably equal to or less than 2. The number of plies may be 1 in all the full length straight sheets.

In light of suppressing winding fault such as wrinkles, a sheet having a too large width is not preferable. In this respect, the number of plies of one hoop sheet is preferably equal to or less than 4, more preferably equal to or less than 3, and still more preferably equal to or less than 2. In light of the working efficiency of the winding process, the number of plies of the hoop sheet is preferably equal to or greater than 1. In all the hoop sheets (hoop layers), the number of plies may be equal to or less than 2. In Example 1 to be described later, or the like, the number of plies is 1 in all the hoop sheets (hoop layers).

Winding fault is apt to occur in the full length sheet. In light of suppressing the winding fault, the number of plies of one sheet in all full length hoop sheets is preferably equal to or less than 2. The number of plies may be 1 in all the full length hoop sheets.

Although not shown in the drawings, the prepreg sheet before being used is sandwiched between cover sheets. The cover sheets are usually a mold release paper and a resin film. The prepreg sheet before being used is sandwiched between the mold release paper and the resin film. The mold release paper is applied on one surface of the prepreg sheet, and the resin film is applied on the other surface of the prepreg sheet. Hereinafter, the surface on which the mold release paper is applied is also referred to as "a surface of a mold release paper side", and the surface on which the resin film is applied is also referred to as "a surface of a film side".

In the developed view of the present application, the surface of the film side is the front side. That is, in FIG. 5, the front side of the figure is the surface of the film side, and the back side of the figure is the surface of the mold release paper side. In FIG. 5, the direction of a line showing the direction of the fiber of the sheet s2 is the same as the direction of a line showing the direction of the fiber of the sheet s3. However, in stacking, the sheet s3 is reversed. As a result, the directions of the fibers of the sheets s2 and s3 are opposite to each other.

In order to wind the prepreg sheet, the resin film is first peeled. The surface of the film side is exposed by peeling the resin film. The exposed surface has tacking property (tackiness). The tacking property is caused by the matrix resin. That is, since the matrix resin is in a semi-cured state, the tackiness is developed. The edge part of the exposed surface of the film side is also referred to as a winding start edge part. Next, the winding start edge part is applied to a wound object. The winding start edge part can be smoothly applied by the tackiness of the matrix resin. The wound object is a mandrel or a wound article obtained by winding other prepreg sheet(s) around the mandrel. Next, the mold release paper is peeled. Next, the wound object is rotated to wind the prepreg sheet around the wound object. In this way, after the resin film is peeled and the winding start edge part is applied to the wound object, the mold release paper is peeled. The procedure suppresses wrinkles and winding fault of the sheet. This is because the sheet to which the mold release paper is applied is supported by the mold release paper, and is less likely to cause wrinkles. The mold release paper has flexural rigidity higher than the flexural rigidity of the resin film.

In the embodiment of FIG. 5, a united sheet is formed. The united sheet is formed by stacking two or more sheets.

In the embodiment of FIG. 5, three united sheets are formed. A first united sheet is formed by stacking the sheet s2 and the sheet s3. A second united sheet is formed by stacking the sheet s4 and the sheet s5. A third united sheet is formed by stacking the sheet s9 and the sheet s10. All the hoop sheets s4 and s9 are wound in a state of the united sheet. The winding fault of the hoop sheet is suppressed by the winding method.

As described above, in the present application, the sheet and the layer are classified by the orientation angle of the fiber. Furthermore, in the present application, the sheet and the layer are classified by the axial-direction length of the shaft.

In the present application, a layer substantially wholly disposed in the axial direction of the shaft is referred to as a full length layer. In the present application, a sheet substantially wholly disposed in the axial direction of the shaft is referred to as a full length sheet. The wound full length sheet forms the full length layer.

A point of 20 mm distant from the tip end Tp in the axial direction is defined as Tp1, and a region between the tip end Tp and the point Tp1 is defined as a first region. A point of 100 mm distant from the butt end Bt in the axial direction is defined as Bt1, and a region between the butt end Bt and the point Bt1 is defined as a second region. The first region and the second region have a limited influence on the performance of the shaft. In this respect, the full length sheet may not be present in the first region and the second region. Preferably, the full length sheet extends from the tip end Tp to the butt end Bt. In other words, the full length sheet is preferably wholly disposed in the axial direction of the shaft.

In the present application, a layer partially disposed in the axial direction of the shaft is referred to as a partial layer. In the present application, a sheet partially disposed in the axial direction of the shaft is referred to as a partial sheet. The wound partial sheet forms the partial layer. The axial-direction length of the partial sheet is shorter than the axial-direction length of the full length sheet. Preferably, the axial-direction length of the partial sheet is equal to or less than half the full length of the shaft.

In the present application, the full length layer that is the straight layer is referred to as a full length straight layer. In the embodiment of FIG. 5, the full length straight layers are a layer s5, a layer s8 and a layer s10. The full length straight sheets are the sheet s5, the sheet s8 and the sheet s10.

In the present application, the full length layer that is the hoop layer is referred to as a full length hoop layer. In the embodiment of FIG. 5, the full length hoop layers are a layer s4 and a layer s9. The full length hoop sheets are the sheet s4 and the sheet s9.

In the present application, the partial layer that is the straight layer is referred to a partial straight layer. In the embodiment of FIG. 5, the partial straight layers are a layer s1, a layer s6, a layer s7, a layer s11 and a layer s12. Partial straight sheets are the sheet s1, the sheet s6, the sheet s7, the sheet s11 and the sheet s12.

In the present application, the partial layer that is the hoop layer is referred to as a partial hoop layer. The embodiment of FIG. 5 does not have the partial hoop layer. In the present invention, the partial hoop layer may be used. In the embodiment of FIG. 5, all the hoop layers are full length hoop layers.

The term "butt partial layer" is used in the present application. Examples of the butt partial layer include a butt partial straight layer and a butt partial hoop layer. In the embodiment of FIG. 5, the butt partial straight layers are the layer s6 and the layer s7. Butt partial straight sheets are the sheet s6 and the sheet s7. In the embodiment of FIG. 5, the butt partial hoop layer is not provided.

An axial-direction distance between the butt partial layer (butt partial sheet) and the butt end Bt is preferably equal to or less than 100 mm, more preferably equal to or less than 50 mm, and still more preferably 0 mm. In the embodiment, the distance is 0 mm.

The term "tip partial layer" is used in the present application. An axial-direction distance between the tip partial layer (tip partial sheet) and the tip end Tp is preferably equal to or less than 40 mm, more preferably equal to or less than 30 mm, still more preferably equal to or less than 20 mm, and yet still more preferably 0 mm. In the embodiment, the distance is 0 mm.

Examples of the tip partial layer include a tip partial straight layer. In the embodiment of FIG. 5, the tip partial straight layers are the layer s1, the layer s11 and the layer s12. The tip partial straight sheets are the sheet s1, the sheet s11 and the sheet s12. The tip partial layer increases the strength of the tip portion of the shaft 6.

The shaft 6 is produced by the sheet-winding method using the sheets shown in FIG. 5.

Hereinafter, a manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 5 is cut out by the process.

The cutting may be performed by a cutting machine. The cutting may be manually performed. In the manual case, for example, a cutter knife is used.

(2) Stacking Process

In the stacking process, the three united sheets described above are produced.

In the stacking process, heating or a press may be used. More preferably, the heating and the press are used in combination. In a winding process to be described later, the deviation of the sheet may be generated during the winding operation of the united sheet. The deviation reduces winding accuracy. The heating and the press improve an adhesive force between the sheets. The heating and the press suppress the deviation between the sheets in the winding process.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet to the mandrel.

The sheets are wound in order described in the developed view. The sheet located on a more upper side in the developed view is earlier wound. The sheets to be stacked are wound in a state of the united sheet.

A winding body is obtained in the winding process. The winding body is obtained by winding the prepreg sheet around the outside of the mandrel. For example, the winding is achieved by rolling the wound object on a plane. The winding may be performed by a manual operation or a machine. The machine is referred to as a rolling machine.

(4) Tape Wrapping Process

A tape is wrapped around the outer peripheral surface of the winding body in the tape wrapping process. The tape is also referred to as a wrapping tape. The tape is wrapped while tension is applied to the tape. A pressure is applied to the winding body by the wrapping tape. The pressure reduces voids.

(5) Curing Process

In the curing process, the winding body after performing the tape wrapping is heated. The heating cures the matrix resin. In the curing process, the matrix resin fluidizes temporarily. The fluidization of the matrix resin can discharge air between the sheets or in the sheet. The pressure (fastening force) of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The process of removing the wrapping tape is preferably performed after the process of extracting the mandrel in light of improving the efficiency of the process of removing the wrapping tape.

(7) Process of Cutting Both Ends

Both the end parts of the cured laminate are cut in the process. The cutting flattens the end face of the tip end Tp and the end face of the butt end Bt.

In order to facilitate the understanding, in all the developed views of the present application, the sheets after both the ends are cut are shown. In fact, the cutting of both the ends is considered in the size in cutting. That is, in fact, the cutting is performed in a state where the sizes of both end portions to be cut are added.

(8) Polishing Process

The surface of the cured laminate is polished in the process. Spiral unevenness is present on the surface of the cured laminate. The unevenness is the trace of the wrapping tape. The polishing extinguishes the unevenness to smooth the surface of the cured laminate. Preferably, whole polishing and tip partial polishing are conducted in the polishing process.

(9) Coating Process

The cured laminate after the polishing process is subjected to coating.

The shaft 6 is obtained in the processes. The shaft 6 is lightweight, and has excellent strength.

In light of the strength of the tip portion of the shaft, the axial-direction length of the tip partial layer is preferably equal to or greater than 50 mm, more preferably equal to or greater than 100 mm, and still more preferably equal to or greater than 150 mm. In light of the weight saving of the shaft, the axial-direction length of the tip partial layer is preferably equal to or less than 400 mm, more preferably equal to or less than 350 mm, and still more preferably equal to or less than 300 mm.

In light of locating the center of gravity G of the shaft closer to the butt end Bt, an axial-direction length of the butt partial layer is preferably equal to or greater than 50 mm, more preferably equal to or greater than 100 mm, and still more preferably equal to or greater than 150 mm. In light of the weight saving of the shaft, the axial-direction length of the butt partial layer is preferably equal to or less than 500 mm, more preferably equal to or less than 400 mm, and still more preferably equal to or less than 300 mm.

In the embodiment, a carbon fiber reinforced prepreg and a glass fiber reinforced prepreg are used. Examples of the carbon fiber include a PAN based carbon fiber and a pitch based carbon fiber.

As described above, a laminated constitution shown in FIG. 5 includes sheets to be shown below.

[Laminated Constitution of FIG. 5]

First Sheet s1: Tip Partial Straight Sheet
Second Sheet s2: Full Length Bias Sheet
Third Sheet s3: Full Length Bias Sheet
Fourth Sheet s4: Full Length Hoop Sheet
Fifth Sheet s5: Full Length Straight Sheet
Sixth Sheet s6: Butt Partial Straight Sheet
Seventh Sheet s7: Butt Partial Straight Sheet
Eighth Sheet s8: Full Length Straight Sheet
Ninth Sheet s9: Full Length Hoop Sheet
10th Sheet s10: Full Length Straight Sheet
11th Sheet s11: Tip Partial Straight Sheet
12th Sheet s12: Tip Partial Straight Sheet The laminated constitution includes the first hoop layer s4 and the second hoop layer s9. Interposition layers which are not hoop layers are present between the first hoop layer s4 and the second hoop layer s9. The interposition layers are the layer s5, the layer s6, the layer s7 and the layer s8. Of the interposition layers, full length layers are the layer s5 and the layer s8. The interposition layers which are the full length layers are full length straight layers.

[Relationship Between a Ratio of a Center of Gravity of a Shaft and GJ Ratio]

Since the center of gravity of the head is positioned apart from the axis line of the shaft, the shaft is so distorted that a face is opened during downswing. A square impact can be achieved by an appropriate turning back of the torsion of the shaft. The phenomenon of turning back of the torsion is referred to as torsion return.

By locating the center of gravity of the shaft on a butt side, the club becomes easier to swing to increase the head speed. Because of the increase of head speed, however, the torsion may not sufficiently turn back upon impact. This phenomenon is also referred to as "swing delay". If the torsion return is insufficient, the head does not sufficiently turn, and thus it is difficult to capture the ball. In other words, when the torsion return is insufficient, the face is apt to be opened upon impact. When the capturing is poor, slice is likely to occur. When the capturing is poor, the ball flies toward the right direction if the golf player is right-handed. A poor capturing results in the decrease of flight distance.

The torsion return is promoted by decreasing GJb/GJt, although the reason is unknown. Therefore, capturing a ball becomes easy by decreasing GJb/GJt. In other words, the swing delay is controlled by decreasing GJb/GJt. A square face at impact can be achieved by decreasing GJb/GJt. Both the increase of head speed and the capturing of a ball can be achieved by increasing the ratio of the center of gravity of the shaft and decreasing GJb/GJt.

[Relationship Between a Flex Point Ratio C of a Shaft and a Turn of the Head]

Generally, it has been known that a head attached to a shaft having low flex point is apt to be turned as compared with a shaft having high flex point. On the other hand, the fact that has been newly found by the present invention is the following phenomenon A. The phenomenon A is shown in Examples to be described later.

[Phenomenon A]: If GJb/GJt is small, a head attached to a shaft having high flex point is apt to be turned as compared with a shaft having low flex point.

The fact that a head attached to a shaft having high flex point is apt to be turned is a phenomenon opposite to conventional sense of the person ordinarily skilled in the art. The phenomenon A cannot be understood by conventional knowledge of the person ordinarily skilled in the art. The reason why the phenomenon A occurs is not known.

[GJb/GJt]

In light of capturing a ball, GJb/GJt is preferably equal to or less than 5.5, more preferably equal to or less than 5.0, still more preferably equal to or less than 4.5, and yet still more preferably equal to or less than 4.3. There is a limit to increasing GJt particularly in a lightweight shaft. In this respect, GJb/GJt is preferably equal to or greater than 2.5, and more preferably equal to or greater than 3.0.

Examples of design items for adjusting GJb/GJt include the following (a1) to (a4).

(a1) a taper ratio of the shaft (mandrel)
(a2) a shape of the bias sheet
(a3) a fiber elastic modulus of the bias layer
(a4) disposal of the tip partial bias layer For example, the following design can be made for the shape of the bias sheet. When GJb/GJt is set to be small, the shape of the bias sheet is adjusted so that the number of plies on the tip part of the shaft is relatively large and the number of plies on the butt part of the shaft is relatively small.

In light of having a head easier to be turned when GJb/GJt is small, the shaft has a flex point ratio C of preferably equal to or less than 0.5, more preferably equal to or less than 0.495, still more preferably equal to or less than 0.49, and still more preferably equal to or less than 0.485. The flex point ratio C of the shaft is preferably equal to or greater than 0.35, and more preferably equal to or greater than 0.40.

Examples of design items for adjusting the flex point ratio C include the following (b1) to (b8).

(b1) a taper ratio of the shaft (mandrel)
(b2) a thickness of the butt partial layer
(b3) a fiber elastic modulus of the butt partial layer
(b4) an axial-direction length of the butt partial layer
(b5) a thickness of the tip partial layer
(b6) a fiber elastic modulus of the tip partial layer
(b7) an axial-direction length of the tip partial layer
(b8) a fiber elastic modulus of the full length layer In light of easiness of swing and head speed, the ratio of the center of gravity of the shaft is preferably equal to or less than 44.5%, more preferably equal to or less than 43.5%, still more preferably equal to or less than 43%, still more preferably equal to or less than 42%, and yet still more preferably equal to or less than 41%. When the ratio of the center of gravity of the shaft is excessively small, the strength at the tip part of the shaft can be deteriorated. In this respect, the ratio of the center of gravity of the shaft is preferably equal to or greater than 25%, and more preferably equal to or greater than 30%.

Examples of means for adjusting the ratio of the center of gravity of the shaft include the following (c1) to (c7).

(c1) a thickness of the but partial layer
(c2) an axial-direction length of the butt partial layer
(c3) a thickness of the tip partial layer
(c4) an axial-direction length of the tip partial layer
(c5) a taper ratio of the shaft (mandrel)
(c6) a shape of each sheet
(c7) a specific gravity of the butt partial layer As described above, the specific tip part R1 and the specific butt part R2 are defined in the present application. A weight of the specific tip part R1 is defined as W1 (*g*). A weight of the full length bias layer on the specific tip part R1 is defined as W1*a* (g). A weight of the tip partial layer on the specific tip part R1 is defined as W1*t* (g). A weight of the specific butt part R2 is defined as W2 (*g*). A weight of the full-length bias layer on the specific butt part R2 is defined as W2*a* (g). A weight of the butt partial layer on the specific butt part R2 is defined as W2*b* (g). The total weight of the shaft 6 is defined as W (g).

In the shaft 6, preferable weight ratios are as follows.

[W1*a* (the Bias Layer of the Specific Tip Part R1)/W1 (the Whole of the Specific Tip Part R1)]

In light of decreasing GJb/GJt, W1*a*/W1 is equal to or greater than 0.20, more preferably equal to or greater than 0.21, and still more preferably equal to or greater than 0.22. In view of the flexural strength of the tip part, an excessively great W1*a* is not preferable. In this respect, W1*a*/W1 is preferably equal to or less than 0.50, more preferably equal to or less than 0.45, and still more preferably equal to or less than 0.40.

[W2*b* (the Butt Partial Layer of the Specific Butt Part R2)/W2 (the Whole of the Specific Butt Part R2)]

In light of decreasing the ratio of the center of gravity of the shaft, W2*b*/W2 is preferably equal to or greater than 0.40, more preferably equal to or greater than 0.41, still more preferably equal to or greater than 0.42, and yet still more preferably equal to or greater than 0.43. In light of preventing the flexural rigidity of the specific butt part R2 from being excessively great, W2*b*/W2 is equal to or less than 0.70, more preferably equal to or less than 0.65, and still more preferably equal to or less than 0.60.

[W2*b* (the Butt Partial Layer of the Specific Butt Part R2)/W2*a* (the Bias Layer of the Specific Butt Part R2)]

In order to decrease GJb/GJt and the ratio of the center of gravity of the shaft, it is effective to decrease W2*a* and to increase W2*b*. In this respect, W2*b*/W2*a* is preferably equal to or greater than 1.7, more preferably equal to or greater than 2.0, and still more preferably equal to or greater than 2.3. In light of preventing the flexural rigidity of the specific butt part R2 from being excessively great, W2*b*/W2*a* is preferably equal to or less than 5.0, more preferably equal to or less than 4.0, and still more preferably equal to or less than 3.5.

[W2*a* (the Bias Layer of the Specific Butt Part R2)/W2 (the Whole of the Specific Butt Part R2)]

In light of decreasing GJb/GJt, W2*a*/W2 is preferably equal to or less than 0.24, more preferably equal to or less than 0.22, and still more preferably equal to or less than 0.20. In light of the torsional strength of the butt part, W2*a*/W2 is preferably equal to or greater than 0.10, and more preferably equal to or greater than 0.12.

[W2*a* (the Bias Layer of the Specific Butt Part R2)/W (the Whole Shaft)]

In light of decreasing GJb/GJt, W2*a*/W is preferably equal to or less than 0.13, more preferably equal to or less than 0.12, and still more preferably equal to or less than 0.11. In light of the torsional strength of the butt part, W2*a*/W is preferably equal to or greater than 0.04, and more preferably equal to or greater than 0.05.

[W2*b* (the Butt Partial Layer of the Specific Butt Part R2)/W (the Whole Shaft)]

In light of decreasing the ratio of the center of gravity of the shaft, W2*b*/W is preferably equal to or greater than 0.15, more preferably equal to or greater than 0.17, and still more preferably equal to or greater than 0.19. In light of preventing the flexural rigidity of the specific butt part R2 from being excessively great, W2*b*/W is preferably equal to or less than 0.40, and more preferably equal to or less than 0.35.

[W2*b* (the Butt Partial Layer of the Specific Butt Part R2)/W1*t* (the Tip Partial Layer of the Specific Tip Part R1)]

In light of decreasing the ratio of the center of gravity of the shaft, W2*b*/W1*t* is preferably equal to or greater than 1.5, more preferably equal to or greater than 1.7, and still more preferably equal to or greater than 1.9. In light of tip strength, W2*b*/W1*t* is preferably equal to or less than 5.0, more preferably equal to or less than 4.0, and still more preferably equal to or less than 3.5.

The greater the weight of the head is, the harder to turn the head is. For this reason, the greater the weight of the head is, the more conspicuous the effect of the present invention is. In this respect, the weight of the head is preferably equal to or greater than 200 g, more preferably equal to or greater than 205 g, and still more preferably equal to or greater than 210 g. Because of a small ratio of the center of gravity of the shaft, easiness of swing is secured even if the weight of the head is great. The head weight is preferably equal to or less than 230 g, and more preferably equal to or less than 220 g.

In light of easiness of swing and flight distance, the shaft weigh W is preferably equal to or less than 65 g, more preferably equal to or less than 63 g, and still more preferably equal to or less than 61 g. In light of strength, the shaft weight W is preferably equal to or greater than 33 g, more preferably equal to or greater than 35 g, and still more preferably equal to or greater than 37 g. In light of securing the degree of freedom in design of the position of the center of gravity, the shaft weight W is preferably equal to or greater than 40 g, and more preferably equal to or greater than 45 g.

The following tables 1 and 2 show examples of utilizable prepregs. These prepregs are commercially available.

TABLE 1

Table 1 Examples of utilizable prepregs

| | | | | | Physical property value of reinforcement fiber | | |
|---|---|---|---|---|---|---|---|
| Manufacturer | Trade name | Thickness of sheet (mm) | Fiber content (% by weight) | Resin content (% by weight) | Part number of fiber | Tensile elastic modulus (t/mm$^2$) | Tensile strength (kgf/mm$^2$) |
| Toray Industries, Inc. | 3255S-10 | 0.082 | 76 | 24 | T700S | 24 | 500 |
| Toray Industries, Inc. | 3255S-12 | 0.103 | 76 | 24 | T700S | 24 | 500 |
| Toray Industries, Inc. | 3255S-15 | 0.123 | 76 | 24 | T700S | 24 | 500 |
| Toray Industries, Inc. | 2255S-10 | 0.082 | 76 | 24 | T800S | 30 | 600 |
| Toray Industries, Inc. | 2255S-12 | 0.102 | 76 | 24 | T800S | 30 | 600 |
| Toray Industries, Inc. | 2255S-15 | 0.123 | 76 | 24 | T800S | 30 | 600 |

TABLE 1-continued

Table 1 Examples of utilizable prepregs

| Manufacturer | Trade name | Thickness of sheet (mm) | Fiber content (% by weight) | Resin content (% by weight) | Physical property value of reinforcement fiber: Part number of fiber | Tensile elastic modulus ($t/mm^2$) | Tensile strength ($kgf/mm^2$) |
|---|---|---|---|---|---|---|---|
| Toray Industries, Inc. | 2256S-10 | 0.077 | 80 | 20 | T800S | 30 | 600 |
| Toray Industries, Inc. | 2256S-12 | 0.103 | 80 | 20 | T800S | 30 | 600 |
| Toray Industries, Inc. | 2276S-10 | 0.077 | 80 | 20 | T800S | 30 | 600 |
| Toray Industries, Inc. | 805S-3 | 0.034 | 60 | 40 | M30S | 30 | 560 |
| Toray Industries, Inc. | 8053S-3 | 0.028 | 70 | 30 | M30S | 30 | 560 |
| Toray Industries, Inc. | 9255S-7A | 0.056 | 78 | 22 | M40S | 40 | 470 |
| Toray Industries, Inc. | 9255S-6A | 0.047 | 76 | 24 | M40S | 40 | 470 |
| Toray Industries, Inc. | 925AS-4C | 0.038 | 65 | 35 | M40S | 40 | 470 |
| Toray Industries, Inc. | 9053S-4 | 0.027 | 70 | 30 | M40S | 40 | 470 |
| Nippon Graphite Fiber Corporation | E1026A-09N | 0.100 | 63 | 37 | XN-10 | 10 | 190 |
| Nippon Graphite Fiber Corporation | E1026A-14N | 0.150 | 63 | 37 | XN-10 | 10 | 190 |

The tensile strength and the tensile elastic modulus are measured in accordance with "Testing Method for Carbon Fibers" JIS R7601: 1986.

TABLE 2

Table 2 Examples of utilizable prepregs

| Manufacturer | Trade name | Thickness of sheet (mm) | Fiber content (% by weight) | Resin content (% by weight) | Physical property value of reinforcement fiber: Part number of fiber | Tensile elastic modulus ($t/mm^2$) | Tensile strength ($kgf/mm^2$) |
|---|---|---|---|---|---|---|---|
| Mitsubishi Rayon Co., Ltd. | GE352H-160S | 0.150 | 65 | 35 | E glass | 7 | 320 |
| Mitsubishi Rayon Co., Ltd. | TR350C-100S | 0.083 | 75 | 25 | TR50S | 24 | 500 |
| Mitsubishi Rayon Co., Ltd. | TR350U-100S | 0.078 | 75 | 25 | TR50S | 24 | 500 |
| Mitsubishi Rayon Co., Ltd. | TR350C-125S | 0.104 | 75 | 25 | TR50S | 24 | 500 |
| Mitsubishi Rayon Co., Ltd. | TR350C-150S | 0.124 | 75 | 25 | TR50S | 24 | 500 |
| Mitsubishi Rayon Co., Ltd. | TR350C-175S | 0.147 | 75 | 25 | TR50S | 24 | 500 |
| Mitsubishi Rayon Co., Ltd. | MR350J-025S | 0.034 | 63 | 37 | MR40 | 30 | 450 |
| Mitsubishi Rayon Co., Ltd. | MR350J-050S | 0.058 | 63 | 37 | MR40 | 30 | 450 |
| Mitsubishi Rayon Co., Ltd. | MR350C-050S | 0.05 | 75 | 25 | MR40 | 30 | 450 |
| Mitsubishi Rayon Co., Ltd. | MR350C-075S | 0.063 | 75 | 25 | MR40 | 30 | 450 |
| Mitsubishi Rayon Co., Ltd. | MRX350C-075R | 0.063 | 75 | 25 | MR40 | 30 | 450 |
| Mitsubishi Rayon Co., Ltd. | MRX350C-100S | 0.085 | 75 | 25 | MR40 | 30 | 450 |
| Mitsubishi Rayon Co., Ltd. | MR350C-100S | 0.085 | 75 | 25 | MR40 | 30 | 450 |
| Mitsubishi Rayon Co., Ltd. | MRX350C-125S | 0.105 | 75 | 25 | MR40 | 30 | 450 |
| Mitsubishi Rayon Co., Ltd. | MR350C-125S | 0.105 | 75 | 25 | MR40 | 30 | 450 |

TABLE 2-continued

Table 2 Examples of utilizable prepregs

| Manufacturer | Trade name | Thickness of sheet (mm) | Fiber content (% by weight) | Resin content (% by weight) | Physical property value of reinforcement fiber: Part number of fiber | Tensile elastic modulus ($t/mm^2$) | Tensile strength ($kgf/mm^2$) |
|---|---|---|---|---|---|---|---|
| Mitsubishi Rayon Co., Ltd. | MR350E-100S | 0.093 | 70 | 30 | MR40 | 30 | 450 |
| Mitsubishi Rayon Co., Ltd. | HRX350C-075S | 0.057 | 75 | 25 | HR40 | 40 | 450 |
| Mitsubishi Rayon Co., Ltd. | HRX350C-110S | 0.082 | 75 | 25 | HR40 | 40 | 450 |

The tensile strength and the tensile elastic modulus are measured in accordance with "Testing Method for Carbon Fibers" JIS R7601: 1986.

EXAMPLES

Hereinafter, the effects of the present invention will be clarified by examples. However, the present invention should not be interpreted in a limited way based on the description of examples.

Example 1

A shaft of Example 1 was obtained in the same manner as in the manufacturing process of the shaft 6. A laminated constitution of Example 1 was the laminated constitution shown in FIG. 5. Specifications of Example 1 are shown in Table 3 below. In Example 1, the following materials were used for the sheets.

First sheet s1: "GE352H-160S" manufactured by Mitsubishi Rayon Co., Ltd.

Second sheet s2: "9255S-7A" manufactured by Toray Industries, Inc.

Third sheet s3: "9255A-7A" manufactured by Toray Industries, Inc.

Fourth sheet s4: "805S-3" manufactured by Toray Industries, Inc.

Fifth sheet s5: "TR350C-125S" manufactured by Mitsubishi Rayon Co., Ltd.

Sixth sheet s6: "TR350C-175S" manufactured by Mitsubishi Rayon Co., Ltd.

Seventh sheet s7: "GE352H-160S" manufactured by Mitsubishi Rayon Co., Ltd.

Eighth sheet s8: "TR350C-150S" manufactured by Mitsubishi Rayon Co., Ltd.

Ninth sheet s9: "805S-3" manufactured by Toray Industries, Inc.

10th sheet s10: "TR350C-150S" manufactured by Mitsubishi Rayon Co., Ltd.

11th sheet s11: "2256S-12" manufactured by Toray Industries, Inc.

12th sheet s12: "2256S-12" manufactured by Toray Industries, Inc.

A head for a driver and a grip were attached to the obtained shaft to obtain a golf club according to Example 1. A head "SRIXON Z545 driver" (loft 10.5 degrees) manufactured by Dunlop Sports Co., Ltd. was used as the head.

Examples 2 to 5 and Comparative Examples 1 to 3

Shafts of Examples 2 to 5 and Comparative Examples 1 to 3 ware obtained in the same manner as in Example 1 except that specifications shown in below Tables 3 and 4 were adopted by using the above described design items. Prepres shown in Tables 1 and 2 were appropriately selected so that desired specifications were obtained. Golf clubs in which these shafts were attached were obtained in the same manner as in Example 1. Specifications and results of evaluations for Examples and Comparative Examples are shown in Tables 3 and 4 below.

TABLE 3

Table 3 Specifications and results of evaluations for Examples and Comparative Examples

| | | Unit | Example 1 | Example 2 | Comp. Ex. 1 | Comp. Ex. 2 |
|---|---|---|---|---|---|---|
| | Shaft length Ls | mm | 1100 | 1100 | 1100 | 1100 |
| | Shaft weight W | g | 52.7 | 52.7 | 52.7 | 52.6 |
| | Ratio of the center of gravity of the shaft | % | 40.9 | 40.9 | 40.9 | 46.3 |
| | Flex point ratio C of the shaft | — | 0.485 | 0.485 | 0.485 | 0.486 |
| Torsional rigidity | GJt | $kgf \cdot m^2$ | 0.51 | 0.48 | 0.47 | 0.48 |
| | GJb | $kgf \cdot m^2$ | 2.08 | 2.60 | 2.65 | 1.77 |
| | GJb/GJt | — | 4.0 | 5.4 | 5.7 | 3.7 |
| Specific tip part | W1a | g | 2.3 | 2.0 | 1.9 | 2.2 |
| | W1t | g | 4.8 | 5.1 | 5.2 | 5.1 |
| | W1 | g | 9.0 | 8.9 | 8.9 | 10.1 |

TABLE 3-continued

Table 3 Specifications and results of evaluations for Examples and Comparative Examples

| | | Unit | Example 1 | Example 2 | Comp. Ex. 1 | Comp. Ex. 2 |
|---|---|---|---|---|---|---|
| Specific butt part | W2a | g | 5.4 | 7.0 | 7.4 | 5.2 |
| | W2b | g | 13.7 | 12.0 | 11.6 | 5.4 |
| | W2 | g | 27.5 | 27.5 | 27.5 | 23.7 |
| Ratio of weights | W1a/W1 | — | 0.26 | 0.22 | 0.21 | 0.22 |
| | W2a/W2 | — | 0.20 | 0.25 | 0.27 | 0.22 |
| | W2b/W2 | — | 0.50 | 0.44 | 0.42 | 0.23 |
| | W2b/W2a | — | 2.52 | 1.71 | 1.57 | 1.04 |
| | W2a/W | — | 0.10 | 0.13 | 0.14 | 0.10 |
| | W2b/W | — | 0.26 | 0.23 | 0.22 | 0.10 |
| | W2b/W1t | — | 2.82 | 2.35 | 2.24 | 1.06 |
| | Head weight | g | 211 | 211 | 211 | 211 |
| Results of evaluation | Head speed | m/s | 43.1 | 43.1 | 43.1 | 42.4 |
| | Flight distance (in total) | yards | 240 | 240 | 239 | 234 |
| | Deviation in right-left direction | yards | 0 | +9 | +13 | −10 |

TABLE 4

Table 4 Specifications and results of evaluations for Examples and Comparative Examples

| | | Unit | Comp. Ex. 3 | Example 3 | Example 4 | Example 5 |
|---|---|---|---|---|---|---|
| | Shaft length Ls | mm | 1100 | 1100 | 1100 | 1100 |
| | Shaft weight W | g | 52.3 | 57.0 | 57.0 | 57.0 |
| | Ratio of the center of gravity of the shaft | % | 49.5 | 40.9 | 40.9 | 40.9 |
| | Flex point ratio C of the shaft | — | 0.443 | 0.495 | 0.490 | 0.509 |
| Torsional rigidity | GJt | $kgf \cdot m^2$ | 0.42 | 0.48 | 0.55 | 0.48 |
| | GJb | $kgf \cdot m^2$ | 1.23 | 2.08 | 2.52 | 2.08 |
| | GJb/GJt | — | 2.9 | 4.3 | 4.6 | 4.3 |
| Specific tip part | W1a | g | 1.8 | 2.0 | 2.2 | 2.0 |
| | W1t | g | 5.7 | 5.0 | 5.1 | 5.0 |
| | W1 | g | 11.0 | 9.6 | 9.6 | 9.6 |
| Specific butt part | W2a | g | 3.8 | 4.6 | 5.0 | 4.6 |
| | W2b | g | 1.1 | 12.4 | 12.6 | 12.4 |
| | W2 | g | 21.2 | 29.0 | 29.0 | 29.0 |
| Ratio of weights | W1a/W1 | — | 0.16 | 0.21 | 0.22 | 0.21 |
| | W2a/W2 | — | 0.18 | 0.16 | 0.17 | 0.16 |
| | W2b/W2 | — | 0.05 | 0.43 | 0.44 | 0.43 |
| | W2b/W2a | — | 0.30 | 2.68 | 2.52 | 2.68 |
| | W2a/W | — | 0.07 | 0.08 | 0.09 | 0.08 |
| | W2b/W | — | 0.02 | 0.22 | 0.22 | 0.22 |
| | W2b/W1t | — | 0.20 | 2.47 | 2.49 | 2.47 |
| | Head weight | g | 211 | 211 | 211 | 211 |
| Results of evaluation | Head speed | m/s | 42 | 43 | 42.9 | 42.8 |
| | Flight distance (in total) | yards | 232 | 239 | 240 | 238 |
| | Deviation in right-left direction | yards | −18 | +3 | +5 | +8 |

Measurement of the torsional rigidity GJ was performed by the above described method. Measurement point (210 mm distant from the butt end Bt) of GJb was the position of 890 mm distant from the tip end Tp. Measurement methods of the forward flex f1 and the backward flex f2 for calculating the flex point ratio C were also as described above.

As evaluation, ball-hitting tests as shown below were performed.

[Ball-Hitting Test]

Ten right-handed testers hit balls. The ten testers had a handicap of 10 to 20. "SRIXON Z-STAR" manufactured by Dunlop Sports Co., Ltd. was used as the ball. Each of the testers hit ten balls with each of the clubs.

In the ball-hitting test, a head speed, a total flight distance, and deviation in a right or left direction were measured. The total flight distance is a flight distance measured at a final arrival point of the ball. The deviation in a right or left direction is a distance of deviation from a target direction. The deviation in the right direction was shown by a positive value and the deviation in the left direction was shown by a negative value. The deviation in a right or left direction was measured at the final arrival point. Average values of the all shots are shown in the above Tables 3 and 4.

Example 1 has a small ratio of the center of gravity of the shaft and is easy to swing. Thus, the head speed is great. Furthermore, because of a small GJb/GJt, it is easy to capture a ball although the head speed is great. For this reason, the deviation in the right or left direction is small.

Example 2 has a small ratio of the center of gravity of the shaft and is easy to swing. Thus, the head speed is great. As compared with Example 1, GJb/GJt is greater. For this reason, the capturing is inferior to that of Example 1, and the deviation to the right side occurred.

Example 3 has a small ratio of the center of gravity of the shaft, and is easy to swing. Thus, the head speed is great. Furthermore, GJb/GJt is small and the capturing is easy. Therefore, the deviation in the right or left direction is small. However, GJb/GJt is greater than that of Example 1, and the hit ball was slightly deviated to the right side.

Example 4 has a small ratio of the center of gravity of the shaft, and is easy to swing. Thus, the head speed is great. Furthermore, GJb/GJt is small, and the capturing is easy. For this reason, the deviation to the right or left side is small. However, GJb/GJt is greater than that of Example 3, and the deviation to the right side is greater than that of Example 3.

Example 5 has a small ratio of the center of gravity of the shaft, and is easy to swing. Thus, the head speed is great. GJb/GJt is small. However, since the flex point ratio of the shaft is great, the capturing is not easy. As a result, the deviation to the right side occurred. As described above, it is a common knowledge for a person ordinarily skilled in the art that a shaft having a great flex point ratio (having low flex point) of the shaft is easy to capture. In Example 5, a result opposite to the common knowledge has been obtained. It has been found that, when GJb/GJt is small, a shaft having high flex point (having a small flex point ratio) is easier to capture.

Comparative Example 1 had a small ratio of the center of gravity of the shaft and a great head speed. However, due to a great GJb/GJt, the capturing was difficult.

Comparative Example 2 had a great ratio of the center of gravity of the shaft and a small head speed. Because of the small head speed, the swing delay was unlikely to occur. In addition to the conditions, because of a small GJb/GJt, the capturing was very easy. As a result, the capturing became excessive, and the deviation to the left side occurred.

Comparative Example 3 had a great ratio of the center of gravity of the shaft, and the head speed was small. GJb/GJt was small, and the capturing was easy. Because of a smaller head speed and a smaller GJb/GJt than those of Comparative Example 2, the capturing was very easy. As a result, the capturing became further excessive.

Thus, Examples have more excellent flight distance and are easier to capture as compared with Comparative Examples. The advantages of the present invention are apparent.

The shafts described above can be used for any golf clubs.

The description hereinabove is merely for an illustrative example, and various modifications can be made in the scope not to depart from the principles of the present invention.

What is claimed is:

1. A golf club comprising a shaft, a head and a grip, wherein the shaft has a plurality of layers, a tip end, and a butt end;

if a distance between a center of gravity of the shaft and the butt end is defined as Lg (mm), a full length of the shaft is defined as Ls (mm), and a ratio of the distance Lg to the full length Ls of the shaft is defined as a ratio of the center of gravity of the shaft, the ratio of the center of gravity of the shaft is equal to or less than 44.5%, if a torsional rigidity at a point of 90 mm distant from the tip end is defined as GJt (kgf·m$^2$), and a torsional rigidity at a point of 210 mm distant from the butt end is defined as GJb (kgf·m$^2$), GJb/GJt is equal to or less than 5.5, GJt is calculated by the following formula 1 based on a torsion angle A1 (radian) generated by applying a torque of 0.139 (kgf*m) to a region including a point separated by 90 mm from the tip end as a center and having a range of 0.1 m, $$GJt(\text{kgf*m}^2)=0.1*0.139/A1, \text{ and} \quad \text{formula 1:}$$

GJb is calculated by the following formula 2 based on a torsion angle A2 (radian) generated by applying a torque of 0.139 (kgf*m) to a region including a point separated by 210 mm from the butt end as a center and having a range of 0.3 m, $$GJb(\text{kgf*m}^2)=0.3*0.139/A2. \quad \text{formula 2:}$$

2. The golf club according to claim 1, wherein the shaft has a flex point ratio of equal to or less than 0.50, wherein if a forward flex is defined as f1, and a backward flex is defined as f2, the flex point ratio C of the shaft is calculated by the following formula:

$$C=f2/(f1+f2).$$

3. The golf club according to claim 1, wherein the layers include a full length bias layer, a full length straight layer, and a butt partial layer, if a region between a point of 180 mm distant from the tip end and the tip end is defined as a specific tip part, a region between a point of 420 mm distant from the butt end and the butt end is defined as a specific butt part, a weight of the specific tip part is defined as W1, and a weight of the full length bias layer on the specific tip part is defined as W1*a*, and a weight of the specific butt part is defined as W2, a weight of the full length bias layer on the specific butt part is defined as W2*a*, and a weight of the butt partial layer on the specific butt part is defined as W2*b*, then W1*a*/W1 is equal to or greater than 0.20, W2*b*/W2 is equal to or greater than 0.40, and W2*b*/W2*a* is equal to or greater than 1.7.

4. The golf club according to claim 1, wherein the head has a weight of equal to or greater than 200 g.

5. The golf club according to claim 1, wherein the shaft has a flex point ratio of equal to or less than 0.495, wherein if a forward flex is defined as f1, and a backward flex is defined as f2, the flex point ratio C of the shaft is calculated by the following formula:

$$C=f2/(f1+f2).$$

6. The golf club according to claim 5, wherein the flex point ratio of the shaft is equal to or less than 0.49.

7. The golf club according to claim 1, wherein the layers include a full length bias layer, a full length straight layer, and a butt partial layer, if a region between a point of 180 mm distant from the tip end and the tip end is defined as a specific tip part, and a weight of the specific tip part is defined as W1, and a weight of the full length bias layer on the specific tip part is defined as W1*a*, then W1*a*/W1 is equal to or greater than 0.20.

8. The golf club according to claim 1, wherein the layers include a full length bias layer, a full length straight layer, and a butt partial layer, if a region between a point of 420 mm distant from the butt end and the butt end is defined as a specific butt part, and a weight of the specific butt part is defined as W2, and a weight of the butt partial layer on the specific butt part is defined as W2*b*, then W2*b*/W2 is equal to or greater than 0.40.

9. The golf club according to claim 1, wherein the layers include a full length bias layer, a full length straight layer, and a butt partial layer, if a region between a point of 420 mm distant from the butt end and the butt end is defined as a specific butt part, and a weight of the full length bias layer on the specific butt part is defined as W2*a*, and a weight of the butt partial layer on the specific butt part is defined as W2*b*, then W2*b*/W2*a* is equal to or greater than 1.7.

* * * * *